US008657258B2

(12) United States Patent
McEwan et al.

(10) Patent No.: US 8,657,258 B2
(45) Date of Patent: Feb. 25, 2014

(54) PORTABLE PUMP JACK

(76) Inventors: Murray Ames McEwan, Grande Prairie (CA); James Lawrence Gaboury, Grande Prairie (CA)

( * ) Notice: Subject to any disclaimer, the term of this patent is extended or adjusted under 35 U.S.C. 154(b) by 154 days.

(21) Appl. No.: 13/065,750

(22) Filed: Mar. 27, 2011

(65) Prior Publication Data

US 2011/0240937 A1 Oct. 6, 2011

(51) Int. Cl.
*B66F 3/00* (2006.01)
*B66C 23/04* (2006.01)

(52) U.S. Cl.
USPC ..... 254/30; 254/134; 254/131; 212/349; 212/348

(58) Field of Classification Search
USPC ..... 254/30, 134, 131, 4 R, 4 C, 10 B, 47, 254/134.5; 212/349, 348
See application file for complete search history.

(56) References Cited

U.S. PATENT DOCUMENTS 5,494,117 A * 2/1996 Aldridge ..... 173/28
6,129,226 A * 10/2000 Donovan ..... 212/300
6,286,695 B1 * 9/2001 Tetreault ..... 212/203

OTHER PUBLICATIONS

Macmillan Dictionary, definition of "jack" <http://www.macmillandictionary.com/dictionary/american/jack>.*

* cited by examiner

*Primary Examiner* — Lee D Wilson
*Assistant Examiner* — Seahee Yoon
(74) *Attorney, Agent, or Firm* — Frank J. Bonini, Jr.; John F. A. Earley, III; Harding, Earley, Follmer & Frailey, P.C.

(57) ABSTRACT

A pump jack for driving a reciprocating pump is provided. The pump jack comprises a support base and a support frame mounted thereto. A hydraulic cylinder is mounted to the support frame. A pulley mechanism is connected to a piston of the hydraulic cylinder, the support frame, and to a sucker rod of the reciprocating pump. The pulley mechanism translates movement of the piston into movement of the sucker rod such that pushing action of the piston provides pulling action acting on the sucker rod. A drive mechanism connected to the hydraulic cylinder for actuating the hydraulic cylinder.

10 Claims, 5 Drawing Sheets

PORTABLE PUMP JACK

BACKGROUND OF THE INVENTION

1. Field of the Invention

The present invention relates to the field of well pumps, and more particularly to a hydraulically operated portable pump jack for driving a reciprocating pump.

2. Brief Description of the Related Art

Conventional donkey head pump jacks have been in use for many years and typically include a walking beam pivotally movable supported by a Samson post with a first end of the walking beam having a donkey head thereon. A wire rope or cable assembly—bridle—connects the donkey head to the upper end of a sucker rod for reciprocating the sucker rod and the down hole pump mounted thereto. The walking beam is driven—at a second end opposite to the first end—by pitman arms which in turn are connected to eccentric cranks on a crank shaft with respective counterweights.

Unfortunately, such pump jacks require substantial maintenance in order to retain the movable components—with the walking beam, the donkey head, and the counter weight being very heavy—properly adjusted and operating. Furthermore, due to the heavy weight of the walking beam, the donkey head, and the counter weight, large forces are acting on the components of the pump jack resulting in substantial wear and material fatigue.

Another disadvantage of the conventional donkey head pump jacks is the need for proper support due to the heavy moving components. Typically, the conventional pump jacks are mounted with bolts to concrete pads which are supported using driven or screw in pilings in the ground making it expensive and time consuming to install, especially in remote areas. Moreover, the heavy movable components and heavy frame components as well as the concrete pads make transportation of the conventional pump jacks extremely time consuming and expensive.

Another disadvantage of the conventional pump jacks is the substantial safety hazard posed by the belt drives, the large rotating counter weights, the pitman arms, and the pivoting walking beam with the donkey head.

Another type of pump jacks are hydraulic pump jacks comprising a substantially vertically oriented hydraulic cylinder which is directly mounted to the well head. The piston of the hydraulic cylinder is directly connected to the sucker rod for providing the reciprocating action acting thereon. The hydraulic pressure for providing the reciprocating action is typically provided by a hydraulic pump driven by a small block gas engine.

While the hydraulic pump jacks are light in construction they still require a crane for installation. Furthermore, they are limited for use with only shallow wells. The side mounting of the hydraulic cylinder on the well head together with the direct mounting of the piston to the sucker rod causes side loading on the hydraulic cylinder, prematurely tearing seals and packing in the gland of the hydraulic cylinder. The resulting oil leaks require regular repair and oil spill attention. Usually, the small block gas engine runs on full power to push the sucker rod up and idles down to lower the sucker rod. The frequent changes from full power to idling and vice versa cause damages to the engine and substantially increases fuel consumption. The complicated electronic direction control of the reciprocating action frequently causes problems, especially in cold conditions.

It is desirable to provide a pump jack that is easy to transport and install.

It is also desirable to provide a pump jack that has substantially reduced maintenance requirements.

It is also desirable to provide a pump jack that has substantially increased safety during operation.

SUMMARY OF THE INVENTION

Accordingly, one object of the present invention is to provide a pump jack that is easy to transport and install.

Another object of the present invention is to provide a pump jack that has substantially reduced maintenance requirements.

Another object of the present invention is to provide a pump jack that has substantially increased safety during operation.

According to one aspect of the present invention, there is provided a pump jack for driving a reciprocating pump. The pump jack comprises a support base and a support frame mounted thereto. A hydraulic cylinder is mounted to the support frame. A pulley mechanism is connected to a piston of the hydraulic cylinder, the support frame, and to a sucker rod of the reciprocating pump. The pulley mechanism translates movement of the piston into movement of the sucker rod such that pushing action of the piston provides pulling action acting on the sucker rod. A drive mechanism connected to the hydraulic cylinder for actuating the hydraulic cylinder.

According to another aspect of the present invention, there is further provided a pump jack for driving a reciprocating pump. The pump jack comprises a support base and a support frame pivotally movable mounted thereto. A hydraulic cylinder is mounted to the support frame. A pulley mechanism is connected to a piston of the hydraulic cylinder, the support frame, and to a sucker rod of the reciprocating pump. The pulley mechanism translates movement of the piston into movement of the sucker rod such that pushing action of the piston provides pulling action acting on the sucker rod. A drive mechanism connected to the hydraulic cylinder for actuating the hydraulic cylinder.

The advantage of the present invention is that it provides a pump jack that is easy to transport and install.

A further advantage of the present invention is that it provides a pump jack that has substantially reduced maintenance requirements.

A further advantage of the present invention is that it provides a pump jack that has substantially increased safety during operation.

BRIEF DESCRIPTION OF THE DRAWINGS

A preferred embodiment of the present invention is described below with reference to the accompanying drawings, in which.

DESCRIPTION OF THE PREFERRED EMBODIMENT

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

While embodiments of the invention will be described for use with oil wells for the sake of simplicity, it will become evident to those skilled in the art that the embodiments of the invention are not limited thereto, but are also applicable for use with water wells as well as to seat or unseat down hole pumps.

Referring to FIGS. 1 to 5, a portable pump jack 100 for driving a reciprocating pump according to a preferred embodiment of the invention is provided. The pump jack 100 comprises a support base 102 for being placed on ground 103 at a well site. Preferably, the structure and dimensions of the support base 102 are designed to facilitate transportation to the well site—using, for example, a truck—and placement at the well site—using, for example, a bull dozer for pulling or pushing the support base 102 across the surface of the ground 103. In one embodiment of the present invention, the support base 102 forms a generally "U" shape at one end thereof to enable placing of the same by pushing or pulling on the ground such that the well head is accommodated therein. The support base 102 is manufactured, for example, as a pair of welded steel "I" beams structurely connected with cross-members to provide structural integrity in a manner known to a person skilled in the art.

Figure 5:
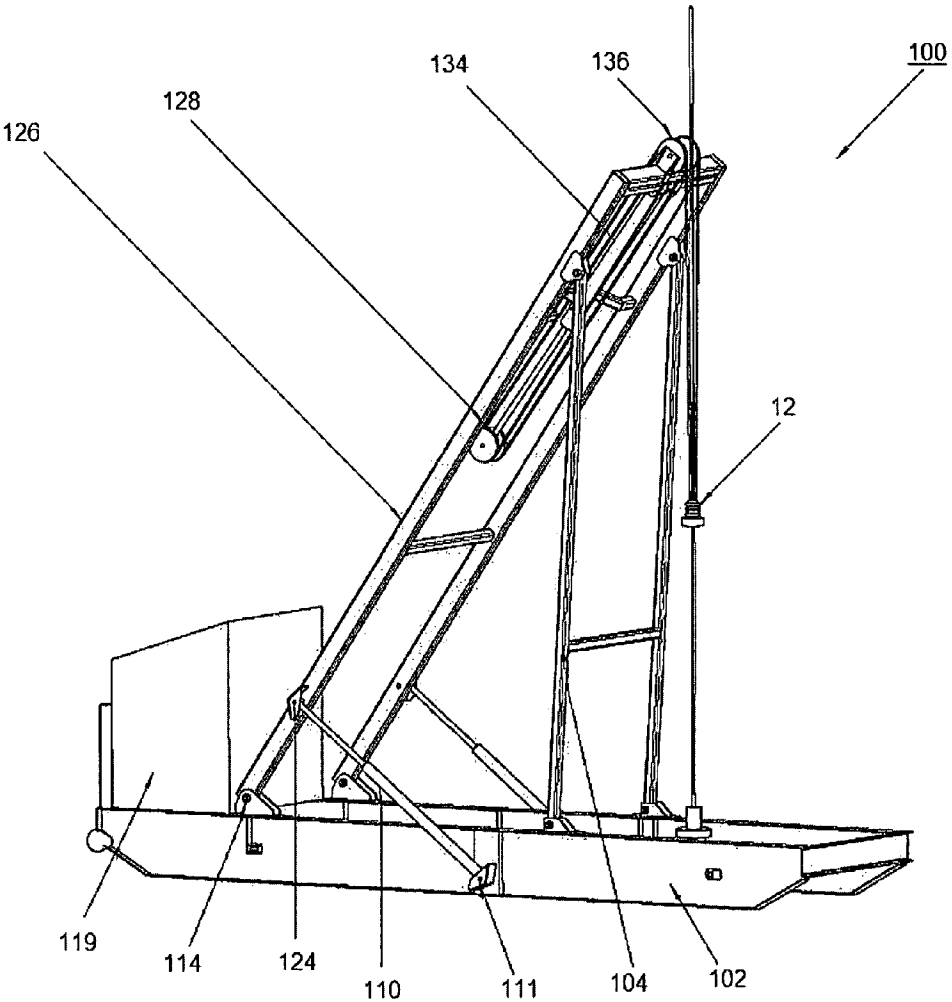

Boom frame 126 is pivotally movably mounted to a left hand side and a right hand side of the support base 102 at pivots 114 and is supported in the operation mode by a left hand side and a right hand side support post 104, respectively (which support posts preferably have one or more structural cross-members therebetween as illustrated in FIG. 5). The left hand side and a right hand side support post 104 are pivotally movably mounted to a left hand side and a right hand side of the boom frame 126 at pivots 130, respectively, and removably mounted to the left hand side and a right hand side of the support base 102, respectively, using, for example, bolts 108. The boom frame 126 and the support posts 104 are made of, for example, steel tubing having a square cross-section. Alternatively, other suitable materials and shapes of cross sections including "I" beams are employed.

Hydraulic pump jack cylinder 134 is mounted to an upper portion of the boom frame 126 (and preferably to support member 140) using conventional mounting techniques such as, for example, screw bolts or welding. Preferably, the hydraulic pump jack cylinder 134 is mounted having an orientation that is substantially parallel to the boom frame 126. Preferably, a double action—or push-pull—hydraulic cylinder 134 is employed. Optionally, in case stronger pushing action is required two or more hydraulic cylinders are employed, placed, for example, side by side and operated simultaneously.

Figure 1:
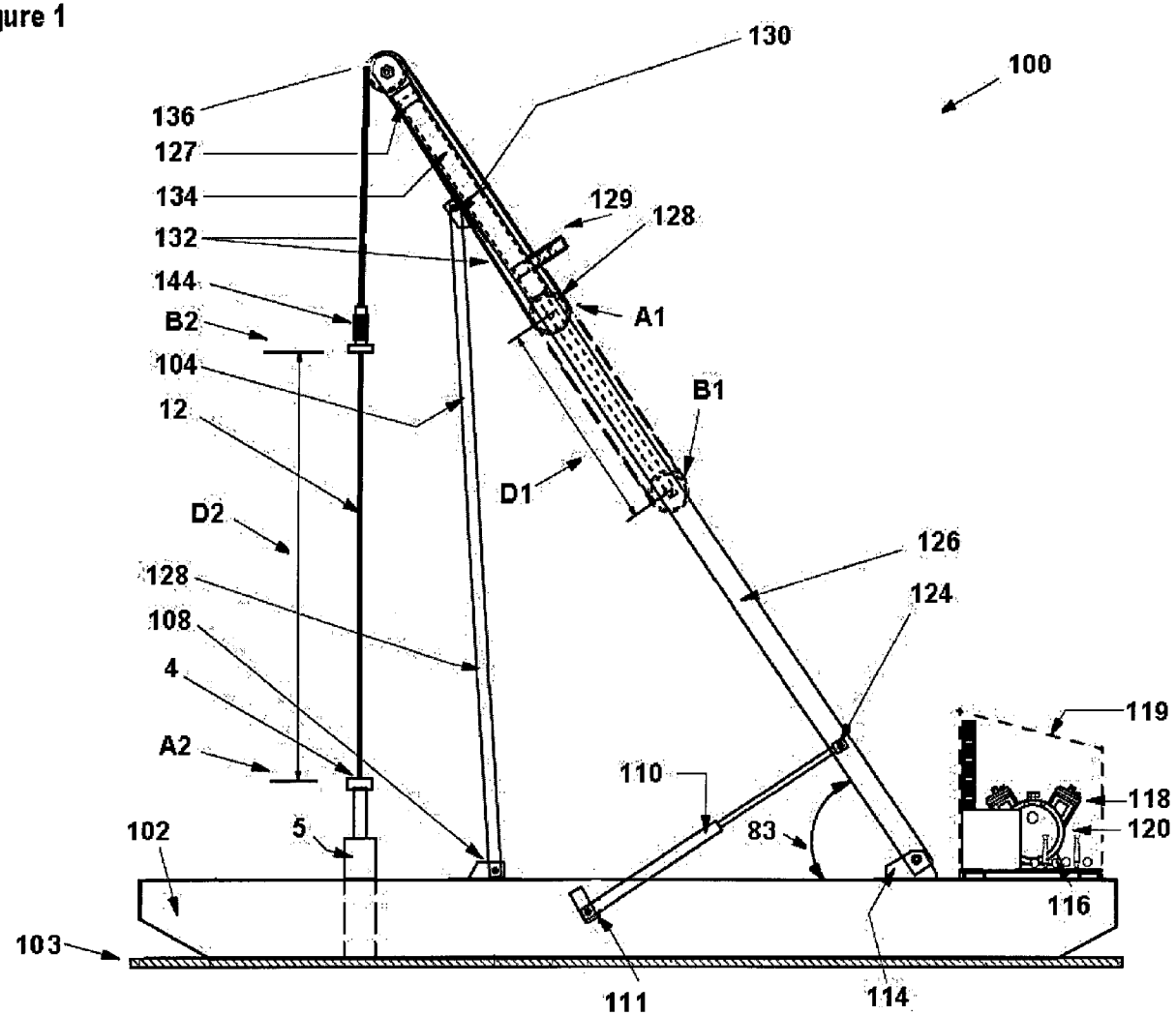
FIG. 1 is a simplified block diagram illustrating a cross-sectional view of a pump jack according to a preferred embodiment of the invention with the pump jack being in operation mode.
Figure 2:
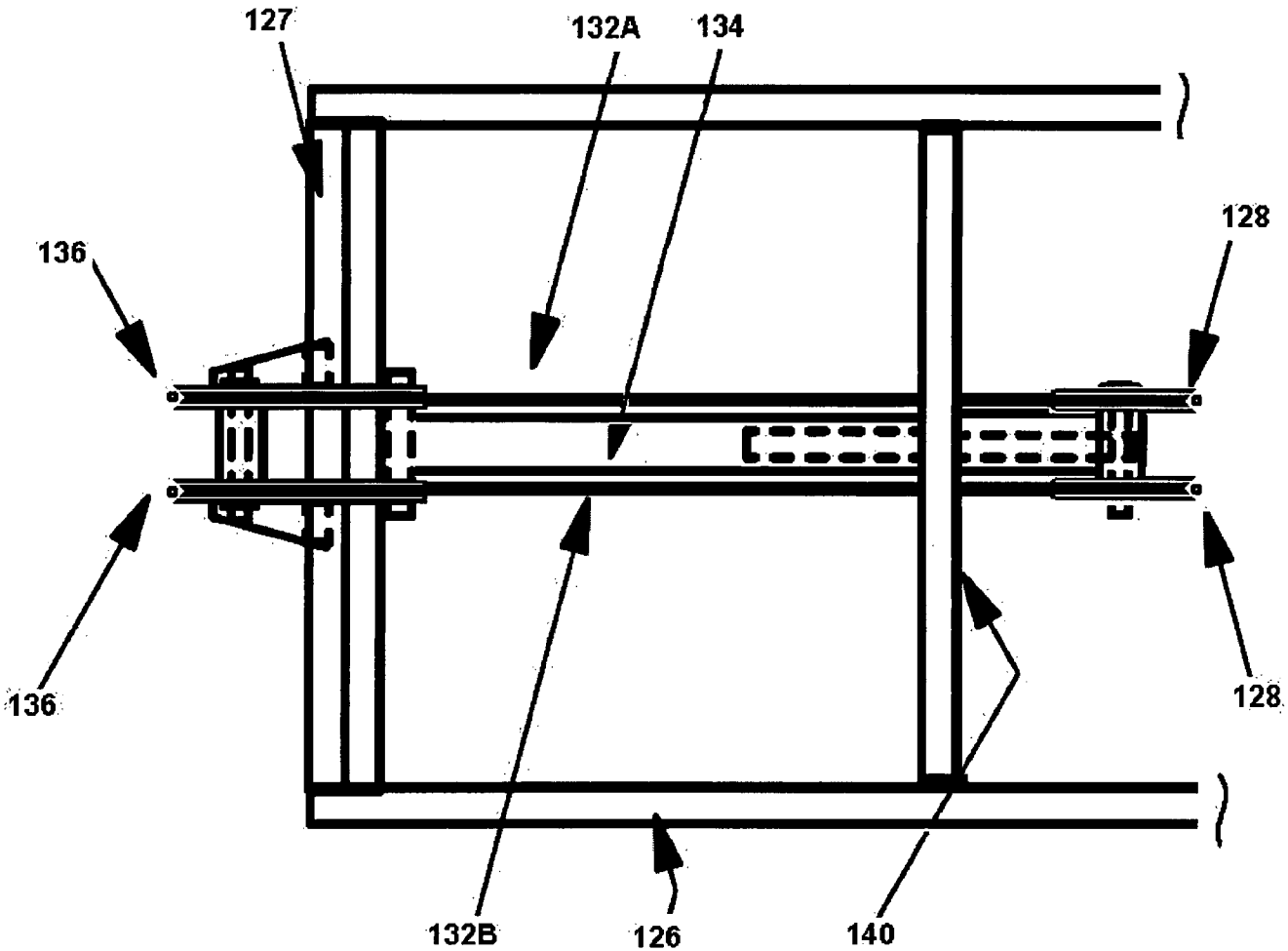
FIG. 2 is a simplified block diagram illustrating a top view of the pulley mechanism of the pump jack according to the preferred embodiment of the invention.
Figure 3:
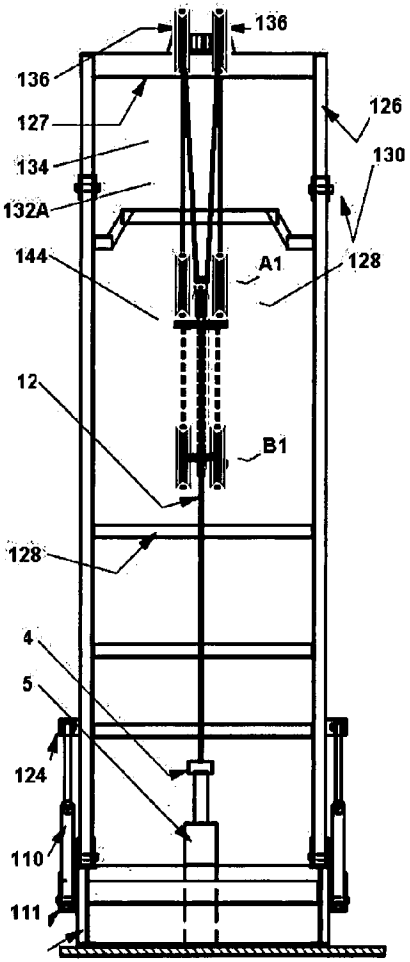
FIG. 3 is a simplified block diagram illustrating a front view of the pump jack according to the preferred embodiment of the invention.

In a preferred embodiment of the present invention, movable pulley 128 is rotatably movably mounted to piston 134A of the hydraulic cylinder 134 using conventional mounting techniques and, preferably, comprises a pair of pulley wheels disposed on opposite sides of the piston 134A to avoid side loading, as illustrated in FIGS. 2 and 3. Fixed pulley wheels 136 are rotatably movably mounted to the top portion of the boom frame 126 such that placing of the connecting member 144, mounted to end portions of cables or wire ropes 132A, B, directly above the well head is enabled for mounting the same to the sucker rod 12, as illustrated in FIGS. 1 and 3. For example, the cables are conventional steel cables terminated in a conventional fashion, for example, in a loop with a thimble for being connected to a hook or bolt or connection assembly mounted to the top portion of the sucker rod 12. The cables 132A, B run from the connecting member 144; over their respective fixed pulley wheels 136; around their respective movable pulley wheels 128; to the top of the boom frame 162 where they are terminated and mounted to—at 127—in a conventional fashion. Alternatively, the pulley mechanism comprises a single cable and single movable and fixed pulley wheels, preferably, centrally placed with respect to the hydraulic cylinder to avoid side loading of the same.

The pulley mechanism translates the pushing action of the piston 134 from location A1 to location B1 into pulling action acting on the sucker rod 12 from respective location A2 to respective location B2, as illustrated in FIG. 1. In this arrangement, the pulley mechanism yields a mechanical advantage of two, i.e. movement of the piston 134 along distance D1 yields movement of the sucker rod 12 along distance D2 which is twice the distance D1, as illustrated in FIG. 1. Employment of the pulley mechanism with the advantage of two substantially reduces wear of the hydraulic cylinder and, thus, inspection and maintenance. Other arrangements of the cables and pulley wheels may be used to provide alternative mechanical advantages in a manner known to a person skilled in the art. The sucker rod 12 being attached at the upper end to connecting member 144 and cables 132A and 132B, is raised as the hydraulic cylinder extends the piston 134 and is lowered by gravity, the sucker rod passing through, for example, a conventional stuffing box 4 and into the well head 5 to pump oil from the well in a conventional manner.

Preferably, the length of the boom frame 126, the length and stroke of the hydraulic 134 are designed such that location B1 of the movable pulley 128 is placed above ground at a distance sufficiently large—for example, 15 to 30 feet—to be out of range of crew members working on ground level, substantially increasing safety.

Figure 4:
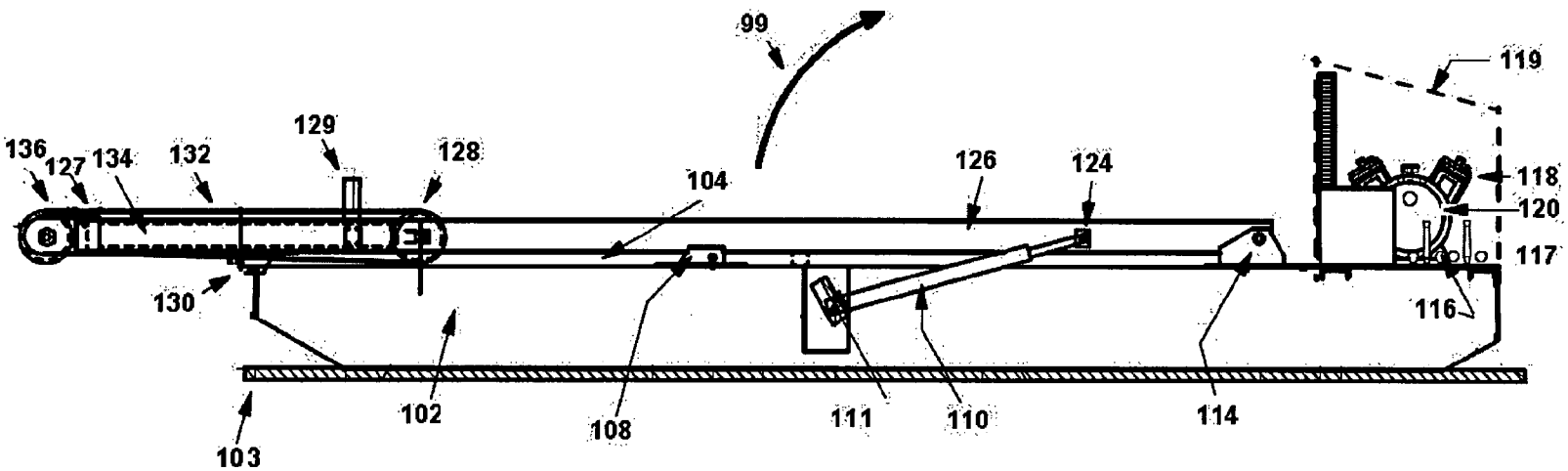
FIG. 4 is a simplified block diagram illustrating a cross-sectional view of the pump jack according to the preferred embodiment of the invention with the pump jack being in transport mode; and, FIG. 5 is a perspective view of the pump jack according to the preferred embodiment of the invention with the pump jack being in operation mode.

The portable pump jack 100 is easily transformed from the operation mode, illustrated in FIG. 1, to a transport mode, illustrated in FIG. 4, and vice versa. For installing the portable pump jack 100 the boom frame 126 is erected by pivoting (as in indicated by the arrow 99) the same around the pivot 114 using a pair of hydraulic boom cylinders 110, rotatably mounted to the left hand side and the right hand side of the support base 102 at pivots 111, respectively, and rotatable mounted to the pivots 124 on the left hand side and the right hand side of the boom frame 126, respectively. For example, the hydraulic boom cylinders 110 are single action hydraulic cylinders for pushing the boom frame 126 while collapsing of the boom frame 126 is executed through gravitational action. Alternatively, double acting hydraulic cylinders are employed.

During the transformation of the jack from the transport mode to the operation mode, the boom frame 126 pivots upwardly (as indicated by the arrow 99) and the pair of support posts 104 are simultaneously moved into an upright, or substantially upright position by being pulled by the boom frame at the pivot 130. Preferably, the bottom end portion of each of the support posts 104 slides along the upper surface of the support base 102 as it moves from the lowered position to the upright position, and vice versa. Alternatively guide rails or other devices known to a person skilled in the art may be utilized to direct and position the bottom end portions of each of the support posts as the support posts are raised and lowered. When the boom frame 126 is in proper position the support posts 104 are bolted 108 to the support base 102 (in the preferred embodiment of the present invention, the boom frame is at a 55 degree angle to the horizontal, it being understood that in alternative embodiments of the present invention, a range of alternative angles may alternatively be utilized). After erection of the boom frame the portable pump jack 100 is placed into a proper position with respect to the well head, for example, by pulling the support base using a bulldozer. For collapsing the boom frame 126, the above process is repeated in reverse order.

Drive mechanism and control is disposed in housing 119 mounted to the support base 102. The drive mechanism comprises, for example, a natural gas engine or diesel engine 118 driving a hydraulic pump 120 and control system 116. The hydraulic fluid is provided from the hydraulic pump 120 to the hydraulic cylinders 110 and 134 via hydraulic lines (not shown) in a conventional manner.

In a prototype implementation pump jack 100, illustrated in FIG. 5, an 80 hp diesel engine has been employed driving a 40 gal/min hydraulic pump providing up to 2500 psi hydraulic pressure for actuating the hydraulic pump jack cylinder 134 as well as the hydraulic boom cylinders 110. The hydraulic pump jack cylinder 134 is a double action hydraulic cylinder having a 6" diameter and a 6' stroke. Therefore, a 12' stroke is provided acting on the sucker rod 12. The direction of the strokes is simply controlled by internal hydraulic pressure differential, thus eliminating complicated electronic direction control. The employed flow control system allows stroke times from 2 strokes per minute to 2 strokes per hour which is changeable while in operation. During test on an oil well with 21000 lbs, the RPM change of the engine between up and down strokes was in the range of only 100-150 RPM.

The prototype of the pump jack 100 weighs approximately 12,000 lbs, and needs only one truck to deliver. A two man crew is sufficient to prepare the site and to install the pump jack 100. Each of erecting and collapsing of the boom frame 126 was completed in less than ½ hr, substantially reducing installation time and easily allowing performing of all maintenance and repair at ground level.

Of course the pump jack 100 is not limited to the dimensions of the prototype but is implementable in various sizes to meet requirements of various applications using off-the-shelf components and conventional technologies.

The present invention has been described herein with regard to preferred embodiments. However, it will be obvious to persons skilled in the art that a number of variations and modifications can be made without departing from the scope of the invention as described herein.

What is claimed is:

1. A pump jack comprising:

a support base;

a support frame mounted to the support base;

a hydraulic cylinder mounted to the support frame;

a pulley mechanism connected to a piston of the hydraulic cylinder and the support frame, the pulley mechanism for being connected to a sucker rod of a reciprocating pump, the pulley mechanism for translating continuous reciprocating movement of the piston into continuous reciprocating movement of the sucker rod such that pushing action of the piston provides pulling action acting on the sucker rod; and, a drive mechanism connected to the hydraulic cylinder for actuating the hydraulic cylinder.

2. The pump jack as defined in claim 1 wherein the hydraulic cylinder comprises a double action hydraulic cylinder.

3. The pump jack as defined in claim 1 wherein the pulley mechanism comprises a movable pulley rotatable movable mounted to the piston of the hydraulic cylinder and a fixed pulley rotatable movable mounted to a top portion of the support frame.

4. The pump jack as defined in claim 1 wherein the support base forms a U shape such that the reciprocating pump is accommodated therein.

5. The pump jack as defined in claim 1 wherein the support frame is pivotally movable mounted to the support base.

6. The pump jack as defined in claim 5 comprising a support post pivotally movable mounted to the support frame.

7. The pump jack as defined in claim 6 wherein a bottom end portion of the support post is linearly movable connected to the support base.

8. The pump jack as defined in claim 5 comprising a hydraulic boom cylinder for moving the support frame.

9. A pump jack comprising:

a support base;

a bottom portion of a support frame mounted to the support base;

a hydraulic cylinder mounted to a top portion of the support frame;

a pulley mechanism connected to a piston of the hydraulic cylinder and the support frame, the pulley mechanism for being connected to a sucker rod of a reciprocating pump, the pulley mechanism for translating continuous reciprocating movement of the piston into continuous reciprocating movement of the sucker rod such that pushing action of the piston provides pulling action acting on the sucker rod, the pulley mechanism comprising a movable pulley rotatable movable mounted to the piston of the hydraulic cylinder and a fixed pulley rotatable movable mounted to a top portion of the support frame; and, a drive mechanism connected to the hydraulic cylinder for actuating the hydraulic cylinder.

10. The pump jack as defined in claim 9 wherein the hydraulic cylinder is mounted such that during pushing action the piston moves in a direction oriented approximately towards the bottom portion of the support frame.

* * * * *